US005271328A

United States Patent [19]

Boulais et al.

[11] Patent Number: 5,271,328

[45] Date of Patent: Dec. 21, 1993

[54] PENDULUM BASED POWER SUPPLY FOR PROJECTILES

[75] Inventors: Kevin Boulais; Wayne L. Hopkins, both of Silver Spring, Md.

[73] Assignee: The United States of America as represented by the Secretary of the Navy, Washington, D.C.

[21] Appl. No.: 7,885

[22] Filed: Jan. 22, 1993

[51] Int. Cl.[5] ..... F42C 11/04

[52] U.S. Cl. ..... 102/207

[58] Field of Search ..... 102/207, 209; 310/67 R

[56] References Cited

U.S. PATENT DOCUMENTS

| | | | |
|---|---|---|---|
| 3,747,529 | 7/1973 | Plattner | 102/207 |
| 4,044,682 | 8/1977 | Karayannis | 102/207 |
| 4,088,076 | 5/1978 | Karayannis | 102/207 |

*Primary Examiner*—Daniel T. Pihulic

*Attorney, Agent, or Firm*—John D. Lewis; Jacob Shuster

[57] ABSTRACT

A field coil stator of an electrical generator is fixed to the fuse body of an explosive projectile within which the rotor of the generator is supported for limited rotation dampened by a pendulum to effectively induce an electrical output from the stator field coils during and after launch of the projectile from an internally rifled gun barrel. The rotor is rotationally isolated from the stator during launch by shock absorbing means to avoid defeat of the pendulum dampening action on the rotor.

17 Claims, 3 Drawing Sheets

PENDULUM BASED POWER SUPPLY FOR PROJECTILES

BACKGROUND OF THE INVENTION

This invention relates generally to an electrical energy source rendered operative after launch of a projectile to energize components of the projectile during flight.

Many projectiles presently require power sources capable of energizing components therein during flight following launch from gun barrels. Heretofore, energization of electronic circuitry for the fuse body of an explosive projectile, for example, relied on stored battery power. Use of batteries in such an environment is of increasing concern because of the impact of associated toxic chemicals involved in battery manufacture, the cost of providing environmental protection and the safety risk in utilizing stored battery energy in an explosive environment.

The use of an electrodynamic generator as the power source after launch of a carrier projectile from its gun barrel would appear to be an attractive alternative to an energy storing battery. Such generators include field coil stators fixed to the projectile body and magnetic rotors. The inertia of a heavy flywheel connected to the rotor has been proposed to prevent rotor rotation relative to the field coils induced by internal barrel rifling during projectile launch. According to other proposals, a ram air driven turbine at the nose of the projectile induces rotation of a generator rotor within a projectile launched from a barrel for power generation purposes. Various feasibility problems are associated with the latter proposed power sources.

Accordingly, it is an important object of the present invention to provide a safer and less costly alternative to an energy storing battery type of power source for energizing electronic circuitry or the like in the fuse portion of an explosive projectile launched from an internally rifled gun barrel.

SUMMARY OF THE INVENTION

In accordance with the present invention, gravitational force is utilized to stabilize the rotor of an electrical generator through a pendulum arrangement within the fuse portion of a projectile launched from an internally rifled gun barrel inducing rotation of the projectile body and the stator of the generator about the rotor axis. The retarding torque of the pendulum applied to the rotor in combination with the launch induced rotation of the stator produces electrical energy extracted during projectile flight directly from the stator field coils.

During ejection travel through the gun barrel, the pendulum and generator rotor are rotationally isolated from the enclosing projectile body being violently spun or rotated about the rotor axis by the internal rifling of the gun barrel. Toward that end, the pendulum and rotor assembly are spring biased in one axial direction to oppose inertial displacement in conjunction with a gas-filled shock absorbing chamber formed in the body of the projectile fuse portion, within which the pendulum and rotor assembly is slidably mounted. Defeat of the subsequent stabilizing function of the pendulum by violent spin of the projectile during launch from the gun barrel, is thereby avoided.

BRIEF DESCRIPTION OF DRAWING FIGURES

Other objects, advantages and novel features of the invention will become apparent from the following detailed description of the invention when considered in conjunction with the accompanying drawing wherein.

DETAILED DESCRIPTION OF PREFERRED EMBODIMENTS

Figure 1:
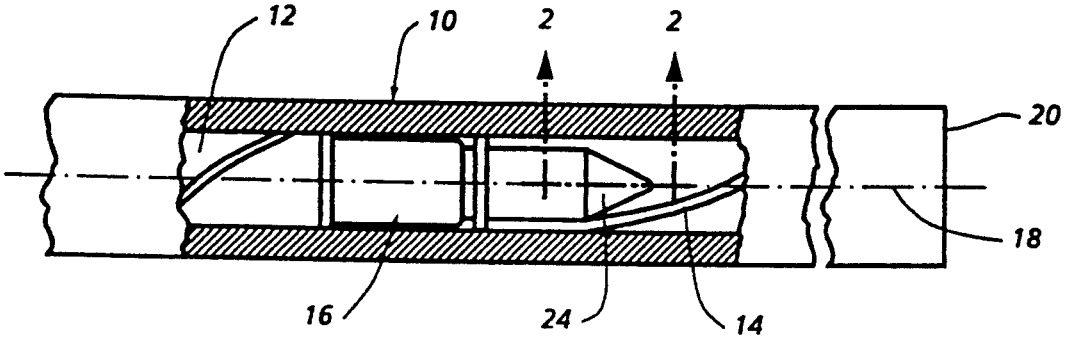
FIG. 1 is a partial side section view through a gun barrel during launching ejection of a projectile therein.

Referring now to the drawing in detail, FIG. 1 illustrates a typical gun barrel 10 having an axial bore 12 with internal rifling 14 formed therein. An explosive projectile, generally referred to by reference numeral 16 within the bore 12 of the barrel, is shown undergoing axial launch by ejection travel along a central axis 18 common to both the bore 12 and projectile 16. During such travel of the projectile 16 through bore 12, it is violently spun about axis 18 by the rifling 14 as is well known in the art. Accordingly, after the projectile 16 is ejected from the axial end 20 of the barrel 10 it will continue to rotate about its axis during flight toward some target.

Figure 2:
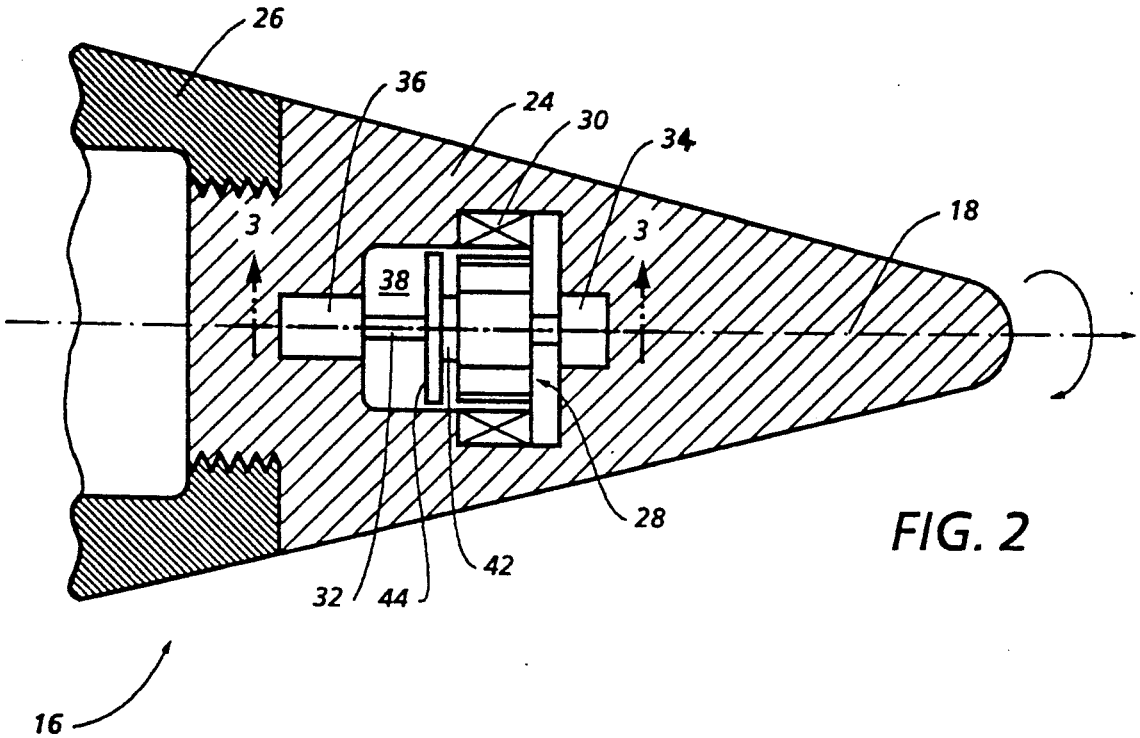
FIG. 2 is an enlarged section view of the forward nose portion of the projectile shown in FIG. 1, taken substantially through a plane indicated by section line 2—2.
Figure 3:
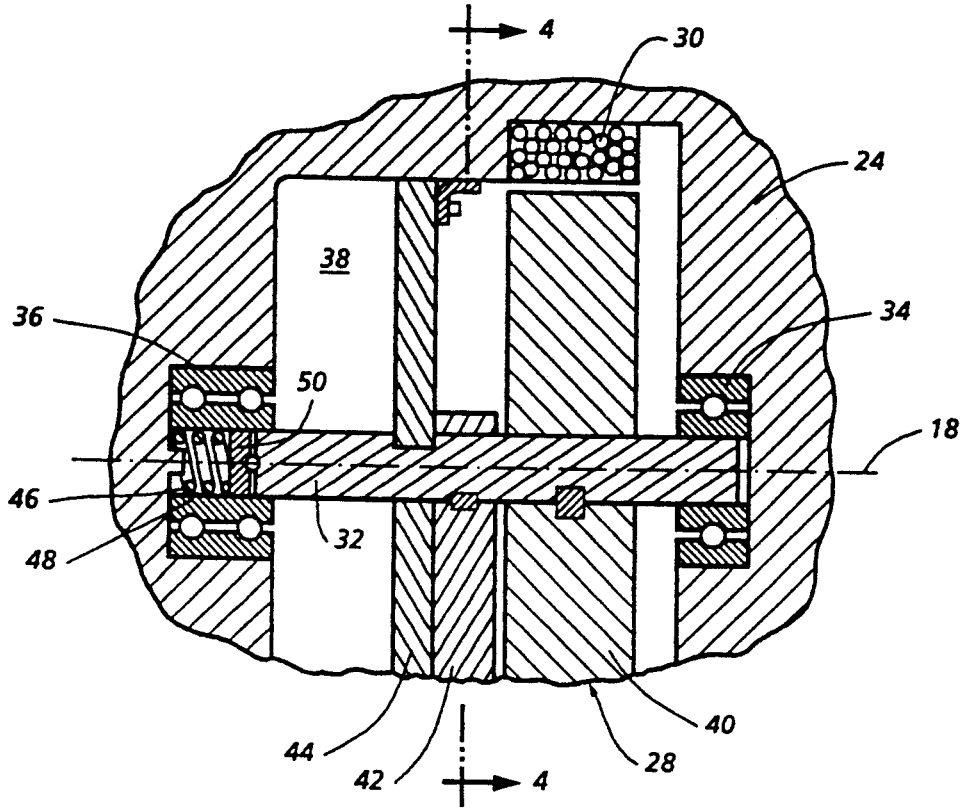
FIG. 3 is an enlarged partial section view taken substantially through a plane indicated by section line 3—3 in FIG. 2.

According to the embodiment of the invention illustrated in FIGS. 2 and 3, an electrodynamic power source is located within a fuse body 24 forming the forward nose portion of the projectile 16, such fuse body being threadedly connected to a rearwardly extending outer shell portion 26 of the projectile. The power source is an electric generator, such as an alternator formed by a gravity stabilized rotor assembly 28 and an annular field stator 30 fixedly mounted within the fuse body 24 in axial alignment with the rotor assembly. A shaft 32 connected to the rotor assembly extends axially therefrom into a forward bearing 34 and a rear bearing 36 at opposite axial ends of a chamber cavity 38 formed in the fuse body 24. The rotor assembly 28 is thereby supported for angular displacement about axis 18 during launch from the barrel 10.

Figure 4:
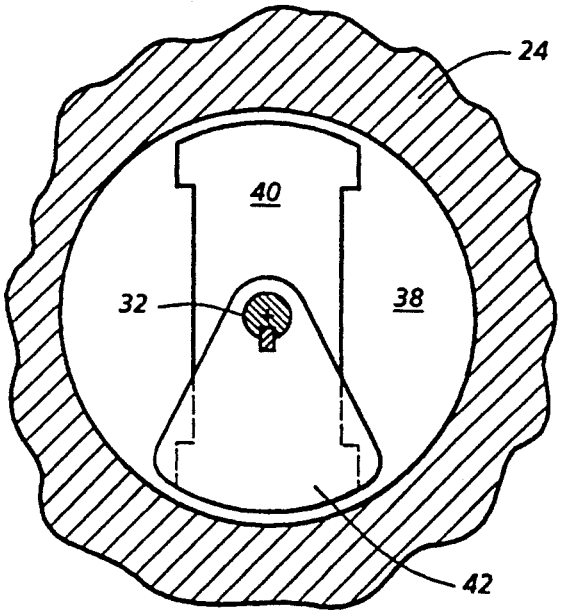
FIG. 4 is a transverse section view taken substantially through a plane indicated by section line 4—4 in FIG. 3 illustrating the pendulum and rotor assembly within the projectile.

As more clearly seen in FIGS. 3 and 4, the rotor assembly includes a magnetic rotor 40 fixed to rotor shaft 32 axially adjacent to a sector-shaped pendulum 42. Also fixed to the rotor shaft 32 is a shock-absorbing piston guide disc 44 disposed in slide bearing relation to the chamber cavity 38 for limiting axial displacement of the rotor assembly induced by inertia forces generated during accelerated ejection travel of the projectile 16 through the barrel bore 12, as aforementioned. Such axial displacement of the rotor assembly is resisted by a suitable gas filling the chamber 38, said gas being compressed during rotor displacement and acting as a damper by exerting a shock-absorbing pressure on the piston guide disc 44 during acceleration of the projectile. The foregoing shock-absorbing damper action is augmented by the bias of a spring 46, shown in FIG. 3. Within a slide bearing guide bore 48 extending through the rear bearing 36, spring 46 reacts between the fuse body and a thrust bearing 50 at one axial end of the rotor shaft 32. Accordingly, contact between the fuse body and rotor assembly during projectile launch is prevented to thereby rotationally isolate the rotor assembly from the fuse body undergoing rotation with the projectile during launch induced by rifling engagement within the barrel bore.

Figure 5:
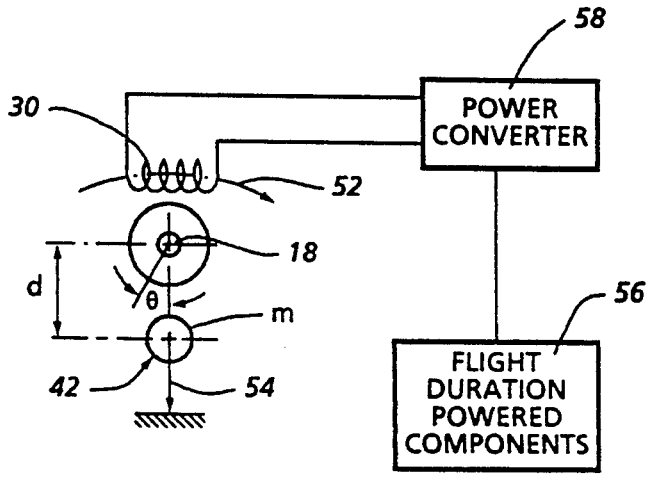
FIG. 5 is schematic diagram of the pendulum stabilized power supply system associated with the projectile illustrated in FIGS. 1–4.

As diagrammed in FIG. 5, the stator 30 is rapidly and continuously rotated as a result of launch about the axis 18 of the rotor shaft 32, as indicated by arrow 52, whereas the rotor 40 is gravitationally stabilized after launch by a rotation resisting torque exerted thereon through the pendulum 42 limiting rotation of the rotor about axis 18 to an angle of ($\theta$) relative to the direction of the earth's gravitational force 54. An electrical output is thereby induced in the stator field coils and supplied during flight of the projectile to powered components 56, such as external electronic circuitry from the fuse. Where the generator formed by the stator 30 and rotor 40 is an alternator, the electrical output from the stator coils is transformed from alternating current (AC) to direct current (DC) by a power converter 58 well known in the art, including a full wave rectifier, capacitor and solid state regulator.

Based on various recognizably acceptable assumptions, such as the principle of energy conservation and neglect of mechanical frictional losses, a formula has been derived for calculating estimates of the hereinbefore described parameters associated with the projectile power source, involving the rotational angle ($\theta$), mass (m) of the pendulum 42, the distance (d) of the center of such pendulum mass from the axis 18 and the launch angle ($\phi$) with respect to a normal to the gravitational force 54. The parameter estimating formula derived is:

$$md = \frac{iv^2}{4nfr\Delta vg(1 - \cos\theta)\cos\phi},$$

where (i) and (v) are the current and voltage, respectively, required by the fuse, ($\Delta v$) is the voltage ripple on the capacitor of the power converter 58, (fr) is the rotational frequency of the projectile 16, (n) is the number of field coils in the stator 30 and (g) is the acceleration produced by the earth's gravitational force. Utilizing typical values in the above formula ($i=0.1$ amps., $v=30$ volts, $\Delta v=10$ volts, $n=4$, $fr=400$ Hertz and $\theta=20°$, $\phi=0°$), the product (md) is in the order of 0.21 lb.-inch, dimensionally characterizing a pendulum 42 effective to dampen rotor rotation pursuant to the present invention.

Figure 6:
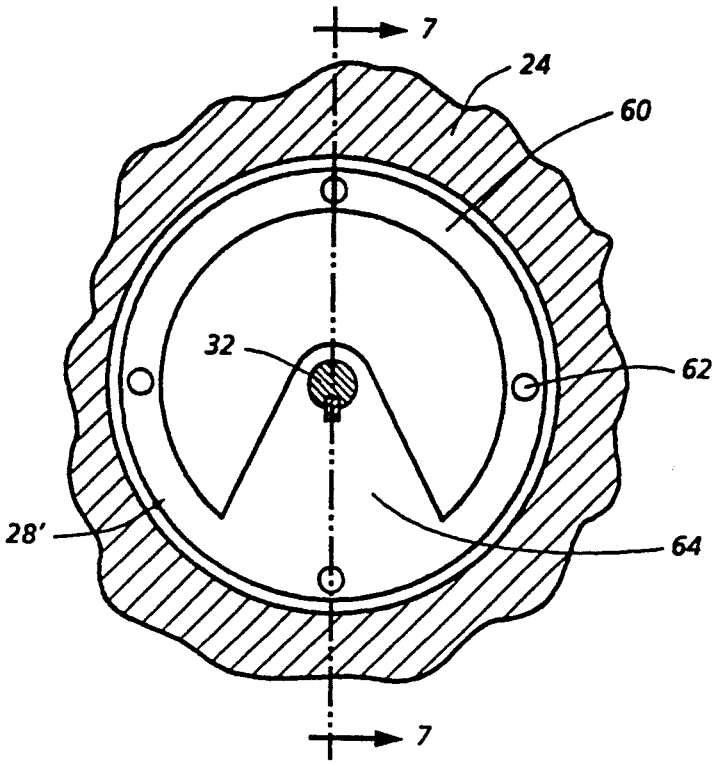
FIG. 6 is a transverse section view similar to that of FIG. 4, showing another embodiment of the pendulum and rotor assembly.
Figure 7:
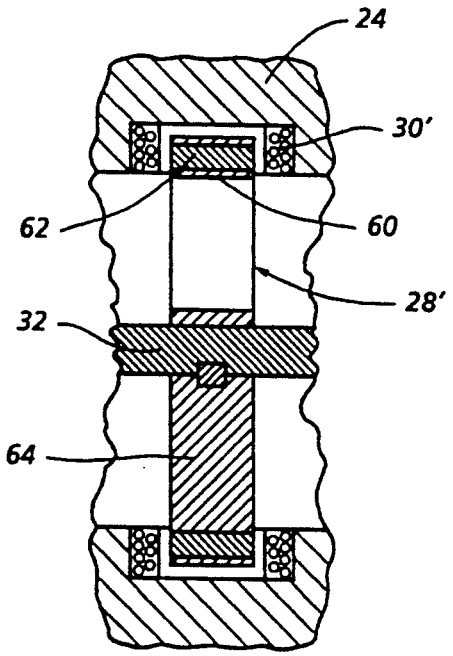
FIG. 7 is a partial side section view taken substantially through a plane indicated by section line 7—7 in FIG. 6.

According to another embodiment of the invention, the pendulum stabilized rotor assembly 28 as hereinbefore described with respect to FIGS. 2, 3 and 4 is replaced by an alternative assembly 28' operatively associated with a correspondingly modified stator 30' within the fuse body 24 as illustrated in FIGS. 6 and 7. The assembly 28' includes an annular rotor member 60 within which magnetic elements 62 are peripherally mounted in angular spaced relation to each other between coils of the stator 30' for inducing electrical current therein during relative rotation. Formed integral with the annular rotor member 60 is an eccentric, sector-shaped pendulum portion 64 to which the rotor shaft 32 is connected. The dampening effect of pendulum portion 64 on rotation of the rotor assembly 28' is similar to that hereinbefore described with respect to the pendulum 42 illustrated in FIGS. 2, 3 and 4.

Numerous other modifications and variations of the present invention are possible in light of the foregoing teachings. It is therefore to be understood that within the scope of the appended claims the invention may be practiced otherwise than as specifically described.

What is claimed is:

1. In combination with a projectile body having an axis about which rotation is induced during launch from an internally rifled barrel, a power source comprising: an electrodynamic stator fixed to the projectile body, a magnetic rotor, bearing means mounting the rotor within the projectile body for angular displacement about said axis, pendulum means connected to the rotor for dampening said angular displacement thereof, means for rotationally isolating the rotor from the projectile body during said launch from the barrel and field coil means mounted by the stator for supply of electrical energy generated therein in response to said rotation of the projectile body during and after said launch thereof.

2. The combination of claim 1 wherein said means for rotationally isolating the rotor includes guide means for accommodating limited axial displacement of the rotor along said axis in response to forces induced during said launch of the projectile body and shock absorbing means for yieldably resisting said axial displacement of the rotor.

3. The combination of claim 2 wherein said shock absorbing means includes spring means for axially biasing the rotor and gas filled chamber means for slidably mounting the rotor within the projectile body.

4. The combination of claim 3 wherein said projectile body includes an outer shell portion and a fuse portion within which the stator and the rotor are mounted.

5. The combination of claim 4 wherein said pendulum means comprises an eccentric mass connected in axially spaced relation to the rotor within the gas filled chamber means.

6. The combination of claim 1 wherein said pendulum means comprises an eccentric mass connected in axially spaced relation to the rotor within the gas filled chamber means.

7. The combination of claim 1 wherein said rotor comprises an annular member having magnetic elements mounted therein and a rotor shaft extending axially from said annular member into the bearing means, said rotor shaft being connected to the annular member by the pendulum means.

8. The combination of claim 1 wherein said projectile body includes an outer shell portion and a fuse portion within which the stator and the rotor ar mounted.

9. In combination with a projectile body having an axis about which rotation is induced during launch, a power source comprising: an electrodynamic stator fixed to the projectile body, a magnetic rotor, bearing means mounting the rotor within the projectile body for angular displacement about said axis, pendulum means connected to the rotor for dampening said angular displacement thereof and electrical converter means connected to the stator for supply of electrical energy induced therein by said rotation of the projectile body relative to the rotor following said launch.

10. The combination of claim 9 wherein said projectile body includes an outer shell portion and a fuse portion within which the stator and the rotor are mounted.

11. The combination of claim 9 wherein said pendulum means comprises an eccentric mass connected in axially spaced relation to the rotor.

12. The combination of claim 9 wherein said rotor comprises an annular member having magnetic elements mounted therein and a rotor shaft extending axially from said annular member into the bearing means, said rotor shaft being connected to the annular member by the pendulum means.

13. In combination with a projectile body having an axis about which rotation is induced during launch, a rotor within the projectile body, bearing means mounting the rotor for angular displacement about said axis and means for rotational isolation of the rotor from the projectile body during said launch, comprising: guide means for limiting axial displacement of the rotor along said axis in response to forces induced during said launch of the projectile body and shock absorbing means for yieldably resisting said axial displacement of the rotor.

14. The combination of claim 13 wherein said shock absorbing means includes spring means axially biasing of the rotor along said axis for resisting said axial displacement of the rotor.

15. The combination of claim 14 wherein said shock absorbing means further includes gas filled chamber means within the projectile body for resisting said axial displacement of the rotor.

16. The combination of claim 15 wherein said projectile body includes an outer shell portion and a nose portion within which the rotor and the means for rotational isolation thereof are mounted.

17. The combination of claim 13 wherein said projectile body includes an outer shell portion and a nose portion within which the rotor and the means for rotational isolation thereof are mounted.

* * * * *